United States Patent [19]

Gagliardi

[11] Patent Number: 4,482,073

[45] Date of Patent: Nov. 13, 1984

[54] SYSTEM FOR RETAINING A CAP WITH RESPECT TO THE NECK OF A RECIPIENT

[75] Inventor: Jean Claude Gagliardi, Oyonnax, France

[73] Assignee: M.B.F. Plastiques, Oyonnax, France

[21] Appl. No.: 547,692

[22] Filed: Nov. 1, 1983

[30] Foreign Application Priority Data

Nov. 18, 1982 [FR] France ..... 82 19624

[51] Int. Cl.[3] ..... B65D 41/06; B65D 41/36

[52] U.S. Cl. ..... 215/332; 215/335

[58] Field of Search ..... 215/332, 335, 222

[56] References Cited

U.S. PATENT DOCUMENTS 784,513 3/1905 Brockelbank ..... 215/332

3,927,783 12/1975 Bogert ..... 215/222

*Primary Examiner*—George T. Hall

*Attorney, Agent, or Firm*—Dowell & Dowell

[57] ABSTRACT

The present invention relates to a system for retaining a cap with respect to the neck of a recipient. A bottle comprises a neck in which are hollowed two diametrically opposite grooves issuing from two top points and each terminating at a bottom point. The part of the grooves located above the top points is eliminated so that the bottom of said grooves opens out freely at the end of the neck. The bottoms of the ramps constituted by the two upper faces of the grooves are provided at their bottom points with a downwardly open notch. The cap comprises two fingers cooperating with the ramps to lock at the end of rotation in the notches. The invention is particularly applicable to the packaging industry.

8 Claims, 7 Drawing Figures

SYSTEM FOR RETAINING A CAP WITH RESPECT TO THE NECK OF A RECIPIENT

The present invention relates to an improved system for retaining a seal or cap with respect to the neck of a recipient, and in particular to a system of this type in which the recipient is closed and opened by rotation through a quarter turn either to the left or to the right, indifferently.

In known stoppering systems, a threaded stopper may be employed whose grooved exterior is engaged by force in a hole of complementary shape made in the cap. The latter may in other cases comprise a conical seal which engages in the ground-in opening of the neck of the recipient. In either case, it is obvious that no means are provided to ensure a determined angular position of the cap with respect to the recipient.

It has already been proposed to make on the neck two ramps whose bottom point is associated with a stop, whilst the bore of the stopper comprises complementary ramps so that the recipient may be closed for example by a quarter turn and opened in the same manner by rotation in opposite direction. However, for the closure to be tight, it is necessary to place a seal at the bottom of the bore of the stopper, but this can only be of reduced thickness since there is little stroke of closure, so that its compression is low and in certain cases tightness is random.

The improvements forming the subject matter of the present invention aim at overcoming the drawbacks of the known closures and at producing a system for retaining a seal or cap with respect to the neck of a recipient which allows a stable and precise angular positioning of the stopper with respect to the recipient, whilst ensuring perfect tightness.

To this end, the retaining system according to the invention comprises two symmetrical ramps made in the neck of the recipient, each starting from two diametrically opposite top points where it is interrupted, whilst it terminates at a bottom point where a locking means incorporating a notch is provided in which two diametrically opposite catches provided in the bore of the cap are engaged.

The invention will be more readily understood on reading the following description with reference to the accompanying drawings, in which.

Figure 1:
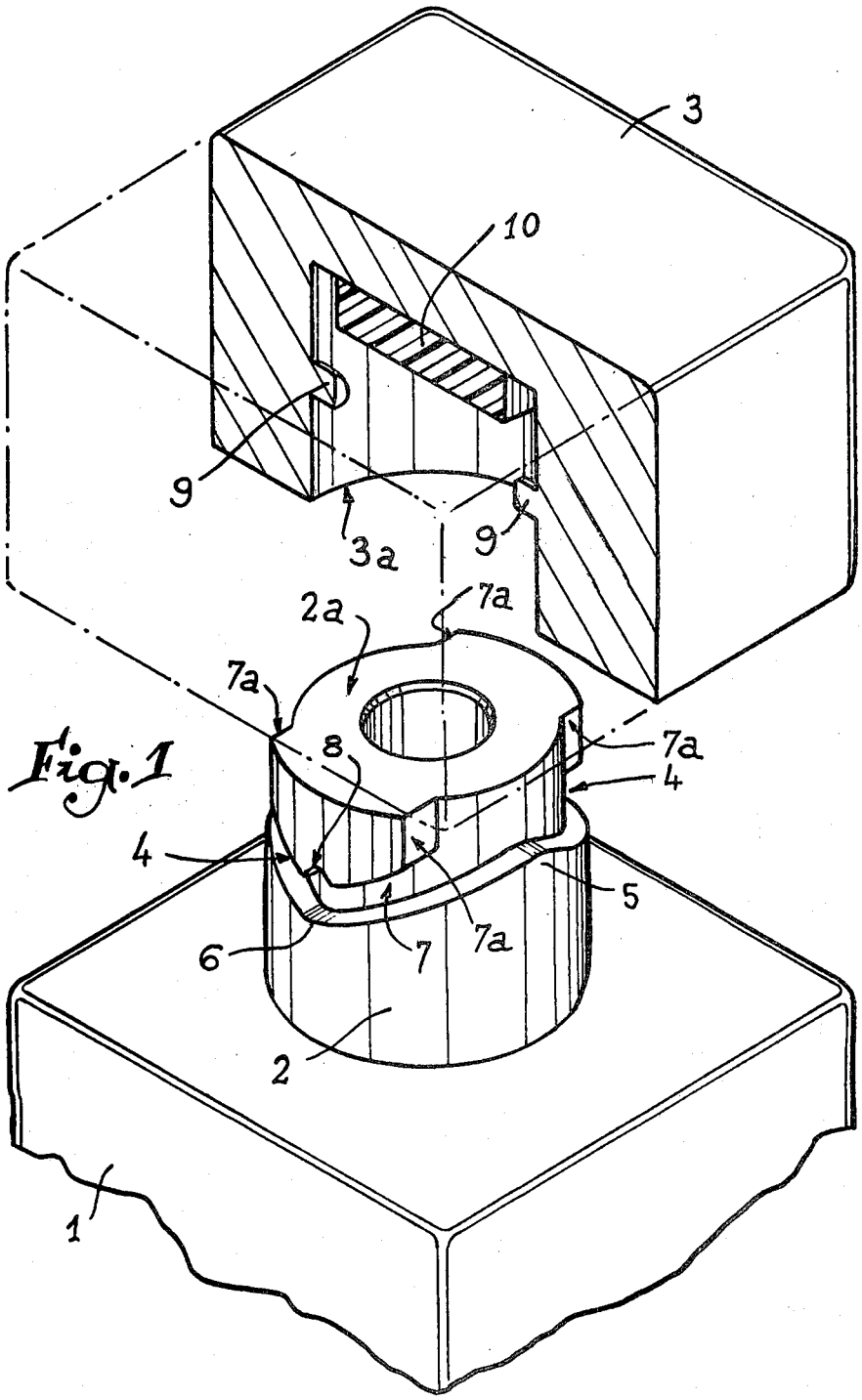
FIG. 1 is a view in perspective with parts torn away of a recipient and its cap provided with a retaining system according to the invention.
Figure 2:
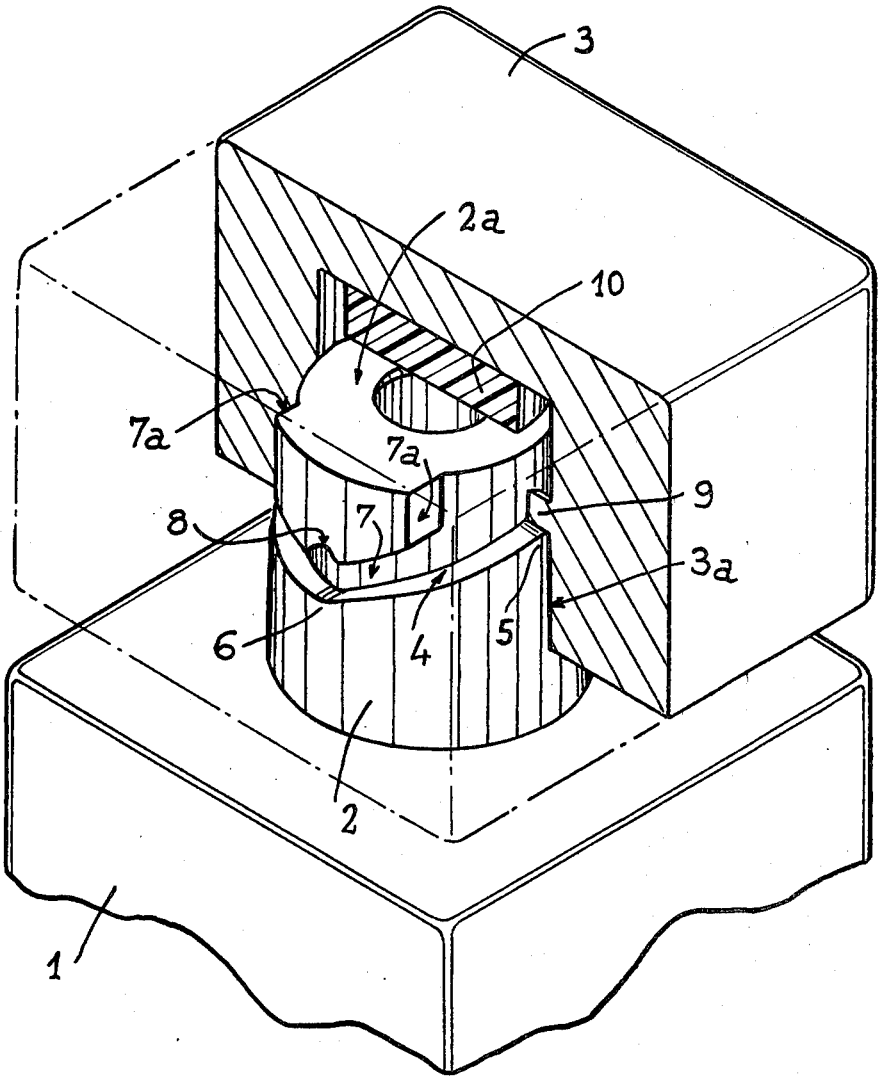
FIG. 2 illustrates how the cap engages in the grooves of the neck.

Referring now to the drawings, FIG. 1 shows in perspective the top part of a recipient such as a bottle 1 provided with a neck 2 with respect to which a seal or cap 3 must be locked so that it is automatically oriented angularly with respect to the bottle. In the case shown, the bottle 1 and the cap 3 are of square transverse section and it is desired that the faces of said cap be exactly in line with those of the bottle 1 once the latter is stoppered.

The neck 2 is hollowed with two identical grooves 4 which are disposed diametrically opposite each other and which comprise two common top points 5 from which the two grooves descend to reach a bottom point 6. In other words, each groove is in the form of a V. It will be observed that the upper face of each of the grooves constitutes a ramp 7 of which the origin 7*a* lies in a zone of the neck whose diameter is identical to that of the bottom of grooves 4, said zone lying above the two top points 5. As illustrated, each groove opens out at its top point on the horizontal face 2*a* of the neck, which therefore presents in profile two arcuate portions whose diameter is equal to that of the core corresponding to the bottom of the grooves 4. The bottom of each of the ramps 7 is provided with a downwardly open notch 8, the two notches of the two ramps being, of course, diametrically opposite each other.

The cap 3 comprises a bore 3*a* from which two diametrically opposite catches 9, whose height is slightly less than the width of the grooves 4, extend towards the centre. The diameter of the bore 3*a* is slightly greater than that of neck 2 so that, if the cap covers the neck 2, the latter engages freely in the bore 3*a* until the catches 9 abut against the lower face of the grooves 4 at their top points 5. Of course, passage of the catches is possible due to the cut-out of the neck above the top points 5 of the two grooves as explained hereinbefore.

Figure 3:
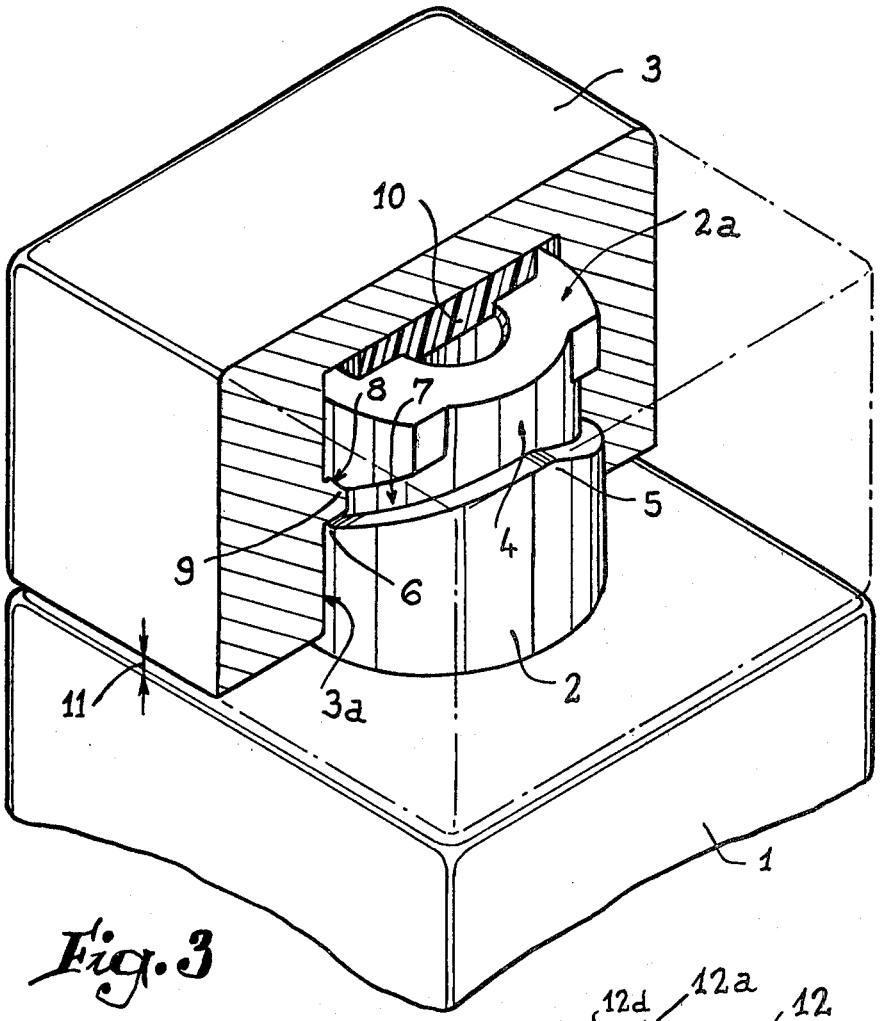
FIG. 3 shows the cap after it has locked with the neck.

To close the recipient, it suffices to rotate the cap in clockwise or anti-clockwise direction. In fact, from the beginning of rotation, the catches 9 engage in the grooves 4 to cooperate with the ramps 7, this bringing about a downward displacement of the cap. In the course of this movement, a seal 10 is compressed as illustrated in FIG. 3 so that the closure of the recipient is tight. The seal 10 may also be mounted at the end of a spring.

At the end of the movement of rotation, i.e. after a quarter turn, the catches cooperate with the notches 8 in which they lock. This locking naturally brings about a slight upward displacement of the cap 3 so that a clearance 11 (FIG. 3) appears after closure between it and the opposite face of the bottle. It will be readily understood that, if the notches 8 and the catches 9 are suitably disposed, the corresponding faces of the cap and the bottle will be strictly in register.

Figure 4:
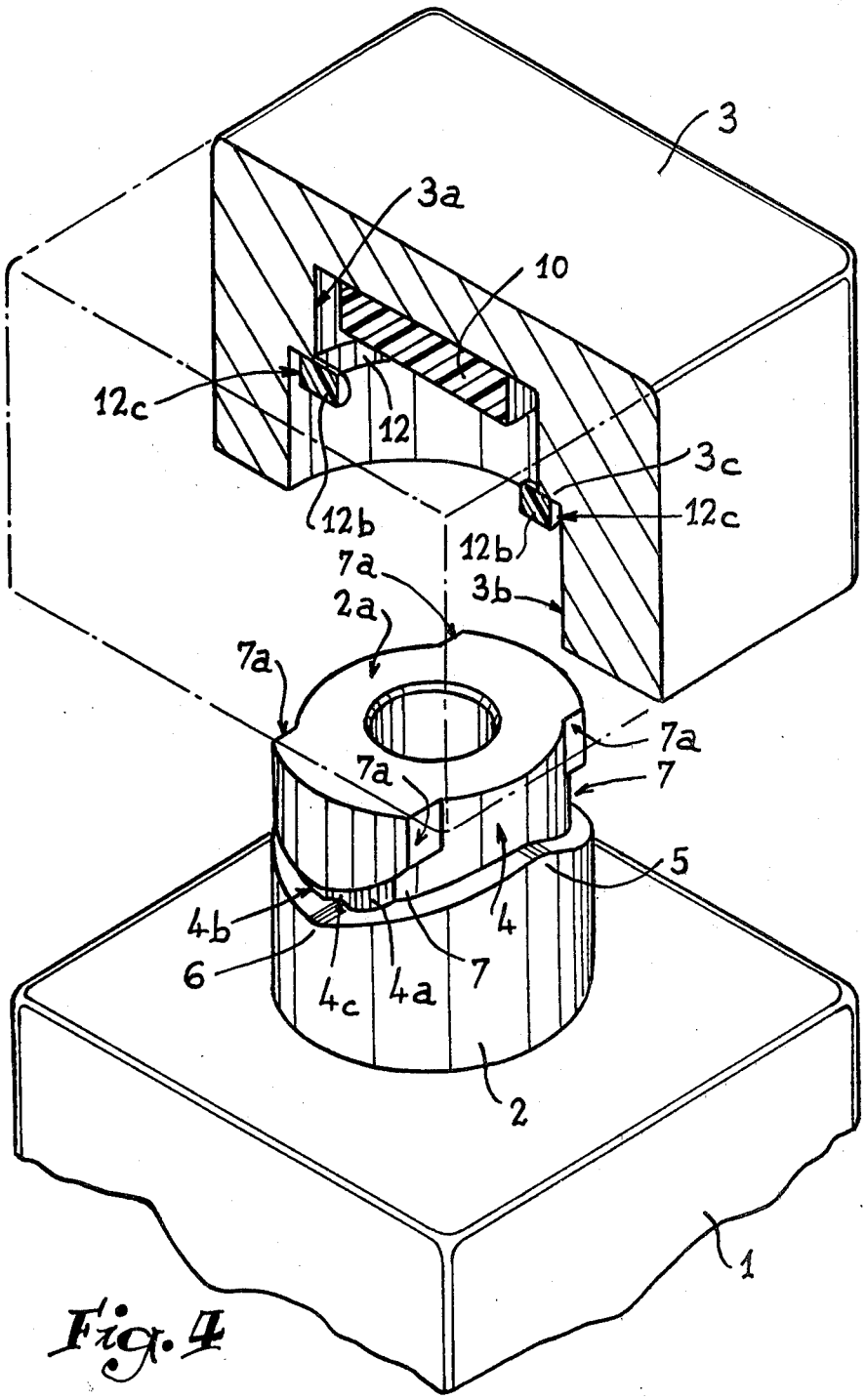
FIG. 4 is a view similar to that of FIG. 1, but relative to a variant embodiment.

In certain particular cases, the users do not accept the existence of the clearance 11. To this end, a variant embodiment is provided according to the invention, illustrated in FIG. 4.

According to a preferred embodiment, the notches 8 are in triangular form and the transverse section of the catches 9 is diamondshaped, so that they lock more markedly in said notches.

Figure 5:
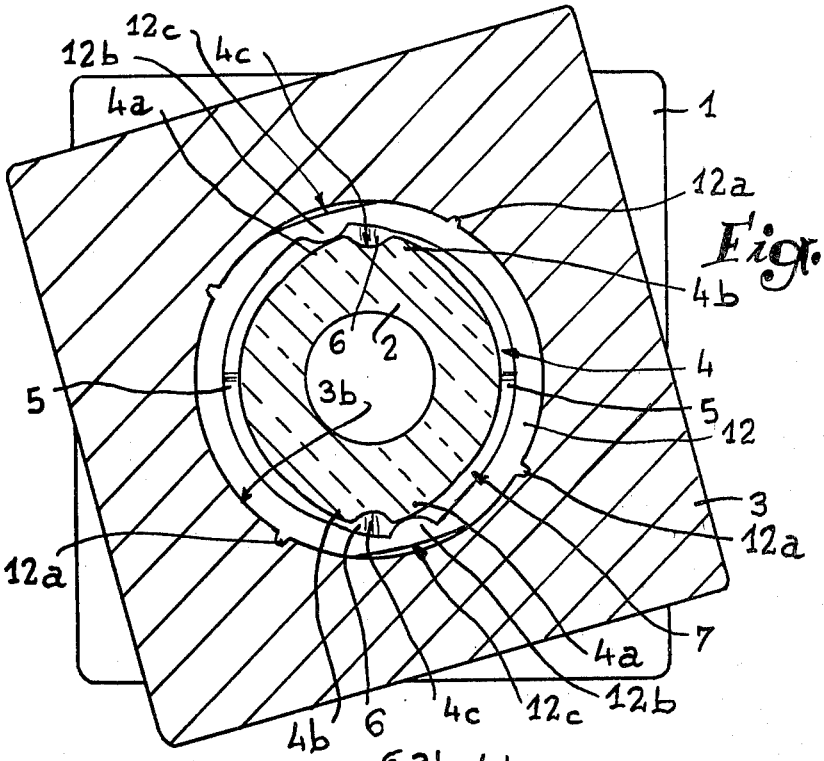
FIGS. 5 and 6 illustrate the manner in which the retaining system of FIG. 4 operates.

In this embodiment, two rounded projections 4*a*, 4*b* are made in the bottom of each groove 4 at its bottom point 6, which projections determine therebetween a depression 4*c* whose bottom lies on a circle corresponding to the bottom of the grooves 4. The projections 4*a*, 4*b* of the two grooves are of course diametrically opposite one another as illustrated in FIG. 5.

The cap 3 is provided with a recess 3*b* by which the bore 3*a* opens out on the lower face of the cap, and whose diameter is, of course, larger than that of this bore. The bottom of the latter is provided, as in the first variant, with an elastic, axially compressible seal 10. Against the shoulder determined by the bore 3*a* and the recess 3b, which has been referenced 3c, there is placed a thick ring 12 made of a rigid elastic material such as polypropylene or an acetal resin. The ring 12 comprises outer vertical beads 12a which penetrate by force in complementary grooves made in the recess 3b so that said ring is immobilized angularly with respect to cap 3. The inner face of the ring 12 comprises two diametrically opposite fingers 12b whose section in plan is complementary of that of the depressions 4c in grooves 4 in the neck. Of course, their thickness is equal, to within the clearance, to the width of the grooves as is the case of the catches 9.

Figure 6:
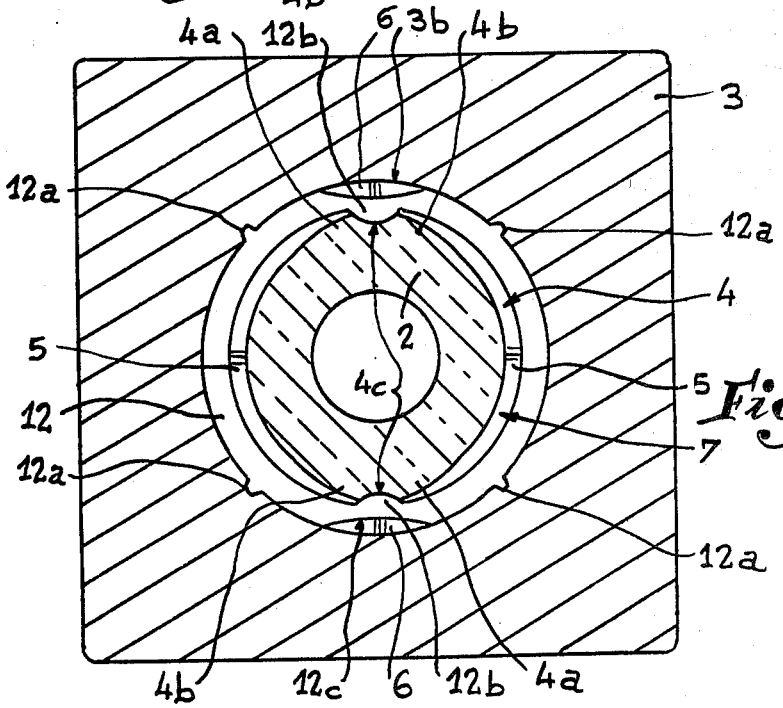

Operation is as follows: When the cap is engaged around the neck, the recess 3b is relatively far from the outside of the lateral wall thereof whilst the ends of the two fingers 12b are distant by a value virtually equal to the diameter of the circle passing through the bottom of grooves 4. Therefore the two fingers engage in the opening part of grooves 4 located above the top points 5 of the grooves. The inner diameter of the ring 12 is provided to engage around the neck, i.e. in particular around the part thereof in which the ramps 7 are formed. The fingers 12b resting on the lower face of the grooves 4 at their top point 5, the cap 3 is rotated through 90° to bring the fingers in question in the bottom of the two grooves. If the cap is rotated in clockwise direction (FIG. 5), the rounded ends of the two fingers 12b cooperate with the projections 4a which push the fingers to the outside due to the fact that the periphery of the ring presents flat portions 12c to the rear of the fingers. By continuing the movement of rotation, these fingers drop in the depressions 4c in which they lock elastically due to the nature of the matter constituting the ring 12. At that moment and as illustrated in FIG. 6, the angular orientation of the cap 3 and that of bottle 1 correspond exactly to each other. Moreover, as the cap does not rise at all upon locking, the clearance 11 may be virtually eliminated or at least brought to a value such that the distance between the cap and the bottle is invisible to the naked eye. It goes without saying that the ring 12 must be maintained firmly in the axial direction. One solution would consist in gluing it against the shoulder 3c. It may also be engaged in the manner of a circlips in a groove made in the recess 3b at shoulder 3c level.

As in the case of the first variant, the seal 10 is compressed by the axial displacement of the cap, so that tightness is perfect at the end of stoppering.

A system for retaining a cap with respect to the neck of a recipient is thus produced which ensures perfect tightness whilst ensuring the desired angular orientation of the cap with respect to the bottle. In addition, thanks to the system according to the invention, the bottle is closed and opened by imparting to the cap a movement of rotation through a quarter turn in one direction or in the other, either to close the bottle or to open it, so that even left-handed persons can replace the cap in its desired angular orientation without difficulty.

Figure 7:
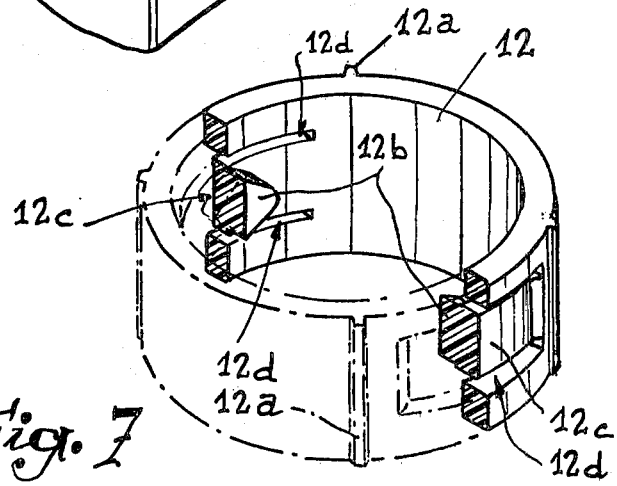
FIG. 7 shows in perspective a preferred embodiment of the finger-bearing ring.

It must, moreover, be understood that the foregoing description has been given only by way of example and that it in no way limits the domain of the invention which would not be exceeded by replacing the details of execution described by any other equivalents. In particular, the quality of stoppering may be improved by providing the ring 12 with two horizontal slots 12d located above and beneath each finger 12b so that it is elastic in the vertical direction. In this way, thanks to this arrangement, the clearances due to the variations of the ribs of the neck may be automatically compensated (FIG. 7).

What is claimed is:

1. In a system for retaining a cap with respect to the neck of a recipient of the type comprising means for angularly orienting the cap with respect to the neck, said neck comprises two symmetrical ramps each of which starts from two diametrically opposite top points where it is interrupted, to terminate at a bottom point where a locking means incorporating a notch is provided, whilst the cap is provided with two diametrically opposite, inwardly facing catches which penetrate under the ramps so that, during its rotation, the cap is applied against the neck and locked in a desired angular position determined by the notched locking means.

2. The retaining system of claim 1, wherein each ramp is constituted by the upper face of a groove hollowed in the periphery of the neck, in the form of a V.

3. The retaining system of claim 2, wherein the notches are constituted by two notches hollowed upwardly in the ramps so as to face downwards to receive the two catches of the cap which are provided to be fixed, and this cap comprises an axially elastic seal so that the closure is tight.

4. The retaining system of claim 2, wherein the zone of each ramp located in its low part comprises two rounded projections determining a depression therebetween whilst the catches of the cap are constituted by two fingers formed on the inside of an elastic ring fast with a housing made in the bore of the cap.

5. The retaining system of claim 4, wherein the periphery of the ring comprises two flat portions located level with the fingers so that it can deform freely in centrifugal manner in its housing when said fingers cooperate with the projections of the grooves of the neck.

6. The retaining system of claim 5, wherein the ring is fixed angularly and axially with respect to the cap.

7. The retaining system of claim 4, wherein the bottom of the bore of the cap comprises a seal which may be a male cone entering the opening, of complementary shape, of the neck, a conical annular shaft cooperating with the opening of the neck or a flat seal.

8. The retaining system of claim 4, wherein the ring comprises horizontal slots located on either side of each finger so that it is elastic in the vertical direction.

* * * * *